US007370673B2

(12) United States Patent
Trumbower et al.

(10) Patent No.: US 7,370,673 B2
(45) Date of Patent: May 13, 2008

(54) SELF-CONTAINED ISOLATED PORT

(75) Inventors: Michael Trumbower, Cromwell, IN (US); Jeffrey M. Grau, Fort Wayne, IN (US); Nazih M. Khatib, Ann Arbor, MI (US); Michael P. Wells, Bowling Green, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 214 days.

(21) Appl. No.: 10/875,576

(22) Filed: Jun. 24, 2004

(65) Prior Publication Data

US 2004/0262560 A1 Dec. 30, 2004

Related U.S. Application Data

(60) Provisional application No. 60/482,342, filed on Jun. 25, 2003.

(51) Int. Cl.
*F16K 11/22* (2006.01)
*F16K 31/00* (2006.01)

(52) U.S. Cl. ..... 137/883; 251/214; 251/340; 251/149.4; 62/292

(58) Field of Classification Search ..... 251/264, 251/274, 273, 149.4, 341, 214, 340; 137/883; 62/292, 299
See application file for complete search history.

(56) References Cited

U.S. PATENT DOCUMENTS 2,612,337 A * 9/1952 Maynard ..... 251/340
3,093,155 A * 6/1963 Dawes ..... 137/269
3,856,262 A * 12/1974 Jordan ..... 251/340
3,985,332 A * 10/1976 Walker ..... 251/111
4,159,103 A * 6/1979 Jordan ..... 251/340
4,644,973 A 2/1987 Itoh et al.
4,728,075 A * 3/1988 Paradis ..... 251/122
4,892,117 A * 1/1990 Spalink et al. ..... 137/614.03
5,339,862 A * 8/1994 Haunhorst ..... 137/614.05
5,957,147 A 9/1999 Hubbell, Jr.
6,266,971 B1 7/2001 Schroder et al.
6,341,762 B1 1/2002 Dean et al.
6,354,100 B1 3/2002 Spanos et al.

* cited by examiner

*Primary Examiner*—Ramesh Kirshnamurthy
*Assistant Examiner*—Andrew J. Rost
(74) *Attorney, Agent, or Firm*—Joseph J. Pophal; Daniel J. Whitman

(57) ABSTRACT

A service valve for a refrigerant system comprising a valve body and a system port. The valve body has at least one fluid passage integrated therein including a longitudinal bore. An orifice is located at one end of the bore. An annular protrusion axially extends from the valve body and is symmetrical about the orifice. A valve seat generally surrounds the orifice. The system port includes a valve stem having a first end, a second end, and a bore integrated within. The stem is axially movable within the annular protrusion between at least a first position in which the orifice is closed when the valve stem first end sealingly abuts the valve seat and a second position in which the orifice is open when the valve stem first end is offset from the valve seat. The valve stem is restricted from moving further away from the valve body by the annular protrusion.

7 Claims, 12 Drawing Sheets

SELF-CONTAINED ISOLATED PORT

CROSS-REFERENCE TO RELATED CASES

The present application claims the benefit of the filing date of U.S. Provisional Application Ser. No. 60/482,342; filed Jun. 25, 2003, the disclosure of which is expressly incorporated herein by reference.

FIELD OF THE INVENTION

The present invention relates to valve system ports, and particularly to those ports used in refrigeration systems for charging and evacuating the refrigerant system with refrigerant.

BACKGROUND OF THE INVENTION

Service valves are used in refrigerant systems to conveniently, add and remove refrigerant. Referring to FIG. 13, a common type of service valve is the front-seat valve 730. An example of such a valve is shown in U.S. Pat. No. 4,644,973 to Itoh et al. Front seat valve 730 contains a charge port 735 through which the installation/service technician can gage the system pressure, evacuate the system, or add refrigerant charge to the system. Front seat valve 730 has a front seat 744 that seals against a mating portion of valve body 732. Charge port 735 is equipped with a valve core 737, which prevents refrigerant from escaping charge port 735 until a stem 738 of valve core 737 is depressed by the service hose connection. Valve core 737 is sealed with elastomeric seals which can lose their sealing characteristics over time. When connected to a service hose, a flow path through charge port 735 is opened and the system can be accessed. The volumetric flow rate of gas, into or out of the system, is restricted by this generally small flow path. Therefore, the time required to service the system is negatively increased due to the size.

Another well-known charge port configuration is found on the more costly and bulky back-seat service valve 780, shown in FIG. 14. The back-seat valve has both a front seat 794 and a back seat 791 which seal against sealing surfaces of valve body 783. Front seat 794 works the same way as front-seat valve 730. Back-seat valve 780 offers an isolated charge port without employing a valve core, therefore it must be capped (not shown). A valve stem 787 in this design is back-seated (at 791) during normal operation. Back seat 791 is typically a metal-to-metal seal and offers greater leak prevention than that of front seat valve 730. In the back-seated position, a charge port 785 is sealed off, or isolated, from the system. Thus, the charge port cap can be removed while valve 780 is back-seated without any concern of refrigerant escaping the system. Once the service hose is attached to charge port 785, valve's stem 787 is mid-seated so that charge port 785 is in communication with the system. Servicing the system (evacuation and charging of refrigerant) can be executed with a higher volumetric flow rate due to the lack of restriction in the flow path (no valve core). This larger flow path results in a shorter service time. However back-seat valve 780 is bulky and expensive to manufacture. Plus valve stem 787 has to be manipulated in order to access charge port 785, which is inconvenient for the end user.

Other prior art service valves utilize valve stems that have a component which must be rotated in order to add or remove refrigerant. For example, in many designs the valve stem is threadedly connected to the charging hose assembly in order to add refrigerant. The valve stem is also threadedly connected to the service valve body. Since the valve stem has to be rotated in order to open the service port, the stem may undesirably rotate relative to the service hose. This can be problematic since the sealed threaded connection between the valve stem and charging hose assembly may come unsealed. It is helpful to provide a valve stem that doesn't rotate when it is being opened and closed.

Other prior art service valves have valve stems that can be completely removed from the service valve. If this happens, then a complete loss of refrigerant from the system will occur. This, of course, is quite undesirable not only from an end user vantage point, but also from an environmentally friendly one. For example, the component, which typically is the valve stem, needs to be unseated from the valve body in order to add and remove refrigerant from the system. Prior art designs do not prevent the complete removal of this component and a complete loss of system refrigerant will occur when this happens.

SUMMARY OF THE INVENTION

The present invention provides a service valve for a refrigerant system having a valve body with at least one fluid passage integrated therein including a longitudinal bore. An orifice is located at one end of the bore and an annular protrusion extends axially from the valve body and is symmetrical about the orifice. A valve seat generally surrounds the orifice. The service valve also includes a valve stem having a first end, a second end and a bore integrated within the service valve. The stem is movable within the annular protrusion between at least a first position and a second position. In the first position, the orifice is closed when the valve stem first end sealingly abuts the valve seat. In the second position, the orifice is open, the valve stem first end is offset from the valve seat and the valve stem is restricted from moving away from the valve body by the annular protrusion.

A further feature of the noted service valve is that the movement of the valve stem is in the axial direction. Another feature of the noted service valve is that annular protrusion is an annular collar having a first end affixed to the valve body and a second end having an internal groove with a base portion, a front wall and a rear wall. A further feature has the valve stem having a radially extending flange located between its first and second ends, an annular notch located between the first end and the flange for housing a stem retaining ring, and an annular valley located between the flange and the second end for housing a nut retaining ring. The stem retaining ring contacts the groove rear wall when the valve stem is in the second position. Still another feature has the annular collar second end having a series of external threads on its outer surface for threaded engagement with a series of internal threads of a nut. The nut has a first end with the internal threads and a second end with an inwardly directed shoulder. The shoulder has a front end abutting the stem flange and a rear end abutting the nut retaining ring. Wherein when the nut is rotated in a first direction, the nut shoulder forcedly contacts the stem flange, urging the stem axially towards the valve body, and when the nut is rotated in the opposite direction, the nut shoulder forcedly contacts the nut retaining ring, urging the stem axially away from the valve body. Still yet another feature has the stem retaining ring having a greater resistance to stress than the nut retaining ring.

Another attribute of the noted service valve includes having the valve stem with an outwardly projecting annular portion between the stem first and second ends having a surface shaped for mating with a torque tool. The stem also has an annular notch located between the stem first end and the outwardly projecting annular portion for housing a stem retaining ring, and a series of external threads on its outer surface located axially between the annular notch and the first end. The annular protrusion has a first end, a second end having an internal groove with a base portion, a front wall and a rear wall, and a series of internal threads located between the internal groove and the first end for mating engagement with the series of external threads of the valve stem.

Yet another attribute of the noted service valve includes the annular protrusion having a distal end with an internal groove having a base portion, a front wall and a rear wall. The valve stem further has an annular flange located between the first and second ends, an annular notch located between the first end and the annular flange, and an annular valley located between the annular flange and the second end. The annular notch houses a stem retaining ring. The annular valley houses a nut retaining ring. The stem retaining ring contacts the groove rear wall when the valve stem is in the second position. Further the valve can include a nut having a first end with a series of internal threads for threaded engagement with a series of external threads of the annular protrusion distal end. The nut has a second end with an inwardly directed shoulder having a front end abutting the stem annular flange and a rear end abutting the nut retaining ring.

Still yet another feature of the noted service valve includes the annular protrusion having a series of internal threads located at its distal end. The valve stem further has an annular flange located between the first and second ends, a series of external threads located between the first end and the annular flange, and an annular valley located between the annular flange and the second end for housing a nut retaining ring. The stem external threads abut the annular protrusion internal threads when the valve stem is in the second position. Further, the stem external threads and the annular protrusion internal threads are not engaged in the first and second positions. Yet further, the annular protrusion can have a series of external threads on the outer surface of its distal end for threaded engagement with a series of internal threads of a nut. The nut has a first end having the internal threads and a second end having an inwardly directed shoulder. The shoulder has a front end abutting the stem annular flange and a rear end abutting the nut retaining ring. Still yet, the stem external threads and the annular protrusion internal threads can be of the left-handed variety, whereas the nut internal threads and the annular protrusion external threads can be of the right-handed variety.

Yet another feature of the noted service valve has the annular protrusion with a proximal end, a distal end, an outwardly directed radial extension located between the proximal and distal ends, a flat outer surface located between the proximal end and the radial extension, and a series of external threads located between the radial extension and the distal end. The valve stem has an outwardly directed radially extending flange located between the first and second ends, and an outwardly directed radial extension located between the flange and the second end. The service valve also has a nut with a first end, a second end and a series of internal threads located between the first and second ends. The first end has an inwardly directed front shoulder. The second end has an inwardly directed rear shoulder with a front end abutting the stem radially extending flange and a rear end abutting the stem radial extension. The internal threads matingly engage with the annular protrusion external threads. The inner surface of the front shoulder abuts the annular protrusion flat outer surface and the front shoulder contacts the annular protrusion radial extension when the valve stem is in the second position. When the nut is rotated in a first direction, the nut shoulder front end contacts the stem radially extending flange and urges the stem axially towards the valve body. When the nut is rotated in the direction opposite the first direction, the nut shoulder rear end forcedly contacts the stem radial extension and urges the stem axially away from the valve body.

Still another feature of the present invention provides a service valve for a refrigerant system comprising a valve body, an annular protrusion extending from the valve body and a valve stem. The valve body has at least one fluid passage integrated therein including a bore and an orifice located at one end of the bore. The annular protrusion is symmetrical about the orifice and has a proximal end affixed to the valve body with an inwardly directed extension which provides a sealing edge. The extension has an inner diameter less than the inner diameter of the remainder of the annular protrusion. The annular protrusion further has a distal end with an internal groove with a base portion, a front wall and a rear wall. The valve stem has a first end, a second end and a bore integrated within. The stem is movable within the annular protrusion between at least a first position in which the orifice is closed when the valve stem first end sealingly abuts the protrusion extension sealing edge and a second position in which the orifice is open, the valve stem first end is offset from the protrusion extension and the valve stem is restricted from moving away from the valve body by the groove rear wall. Yet another feature of this noted service valve has the valve stem including an annular flange, an annular notch, and an annular valley. The flange is located between the first and second ends. The notch is located between the first end and the annular flange and houses a stem retaining ring. The valley is located between the annular flange and the second end and houses a nut retaining ring. The stem retaining ring contacts the groove rear wall when the valve stem is in the second position. Further, the annular protrusion second end can have a series of external threads on its outer surface for threaded engagement with a series of internal threads of a nut. The nut has a first end with the internal threads and a second end with an inwardly directed shoulder. The shoulder has a front end abutting the stem annular flange and a rear end abutting the nut retaining ring. When the nut is rotated in a first direction, the nut shoulder contacts the stem annular flange, urging the stem axially towards the valve body. When the nut is rotated in the direction opposite the first direction, the nut shoulder contacts the nut retaining ring and urges the stem axially away from the valve body.

Still a further attribute of the present invention includes having a charge port, in fluid communication with at least one internal passage inside a valve body, with an annular collar, a valve stem, and a nut. The annular collar extends from the valve body and has a proximal end affixed to the valve body with an inwardly directed extension defining a valve seat. The collar further has an external surface with a series of threads located on a portion thereof, and an internal notch for housing a stem retaining ring. The valve stem has a first end, a second end, a bore integrated within, an outwardly directed annular flange located between the first and second ends, a first outwardly directed shoulder located between the annular flange and the first end, and a second outwardly directed nut retaining shoulder located between the annular flange and the second end. The valve stem is moveable within the annular collar between at least a first position in which the stem first end abuts the valve seat and a second position in which the stem first shoulder abuts the stem retaining ring. The nut has a series of internal threads for engagement with the collar series of threads, an inwardly directed shoulder axially affixed to the valve stem between the stem annular flange and the stem nut retaining shoulder. When the nut is rotated in a first direction, the nut shoulder moves the stem axially towards the valve body, and when the nut is rotated in the direction opposite the first direction, the nut shoulder moves the stem axially away from the valve body.

Further features and advantages of the present invention will become apparent to those skilled in the art upon review of the following specification in conjunction with the accompanying drawings.

DETAILED DESCRIPTION OF THE INVENTION

Figure 1:
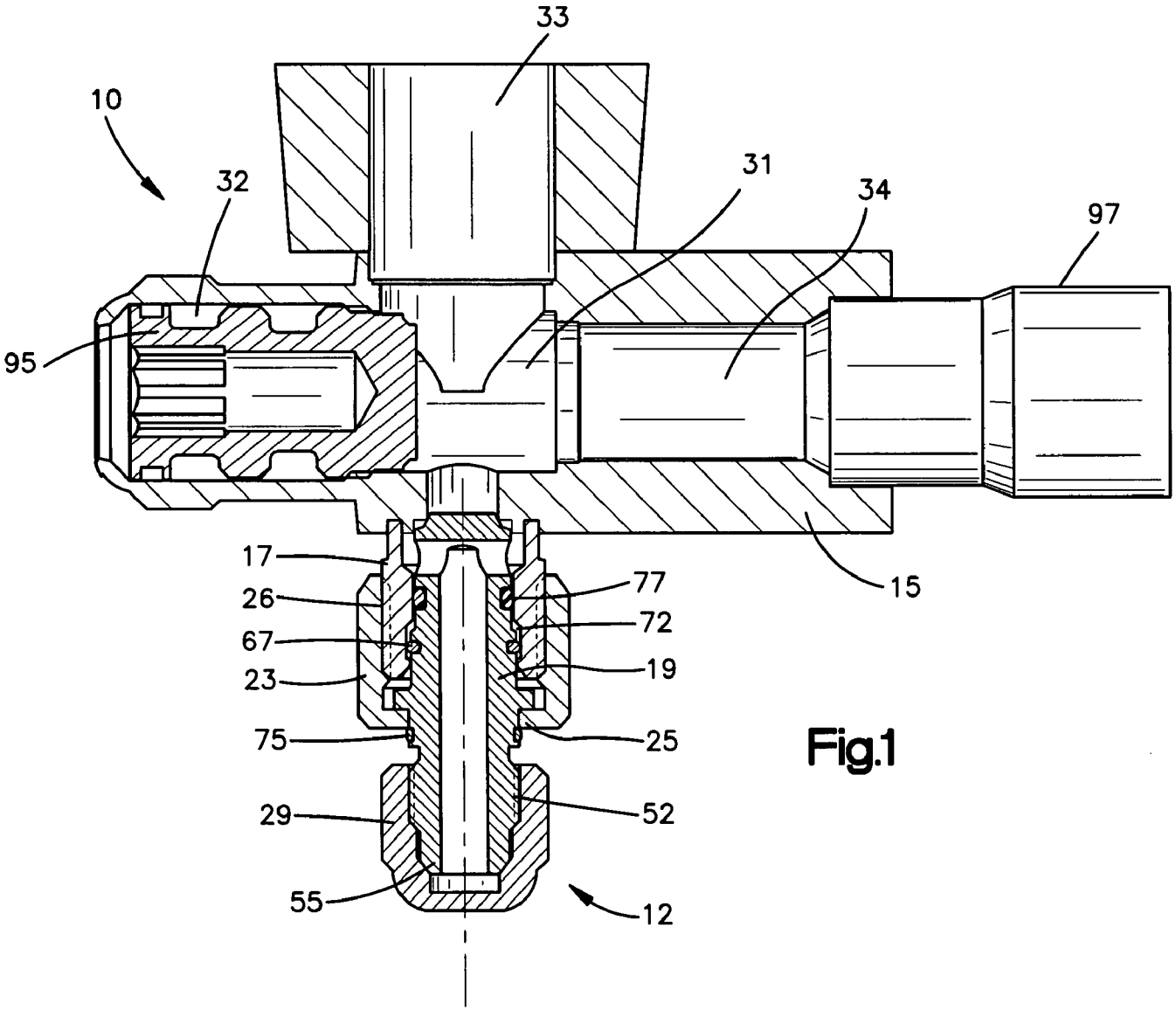
FIG. 1 is a cross-sectional view of a first embodiment for a charge valve according to the present invention.
Figure 4:
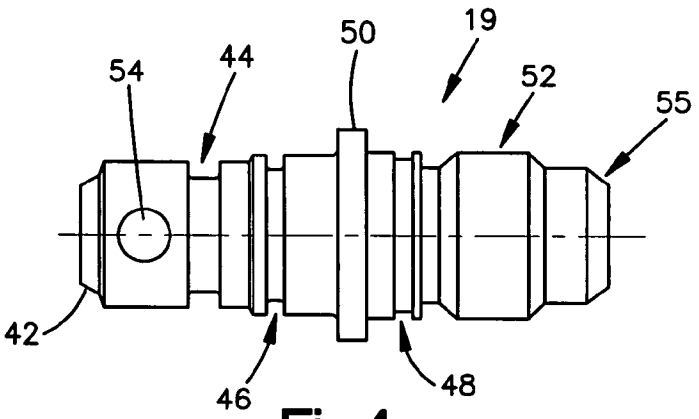
FIG. 4 is a side, elevational view of the valve stem shown in FIG. 1.
Figure 4A:
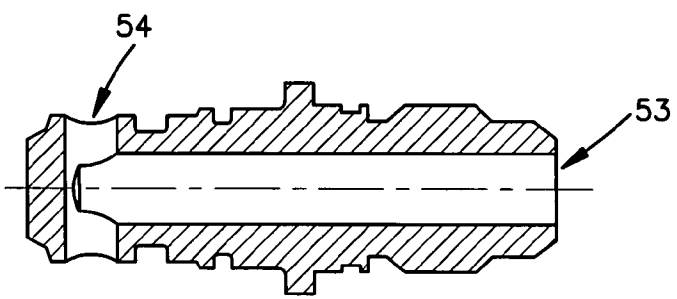
FIG. 4*a* is a longitudinal, cross-sectional view of the valve stem shown in FIG. 4.

Referring to the drawings and in particular to FIGS. 1 through 4*a*, one embodiment of a refrigerant service valve 10, according to the present invention, is shown. Service valve 10 has a unique self-contained isolated port 12 comprised of a valve body 15, an annular braze body 17, a valve stem 19, a nut 23, and a cap 29. Isolated port 12 is used for conveniently charging and evacuation of a refrigerant system. Valve body 15 has a plurality of passages 31 integrated within for fluidly communicating and controlling refrigerant. Although the following passages are detailed for sake of description, it should be noted that service valve 10 could have differing passages without limiting the scope of the invention. Passages 31 include a first passage 32 that receives a front seat valve stem 95 which, as is well known in the art and discussed above, seals against valve body 15 in order to control the flow of refrigerant. A second passage 33 and a third passage 34 are also integrated within valve body 15 and receive tubing which leads to componentry, e.g. the evaporator, compressor and condensing unit, of the refrigerant system. Third passage 34 is shown connected with a tube 97 that would lead to such a component. While isolated port 12 will be described in the context of a refrigerant system, it is to be understood that this description is not intended to be limiting.

Figure 13:
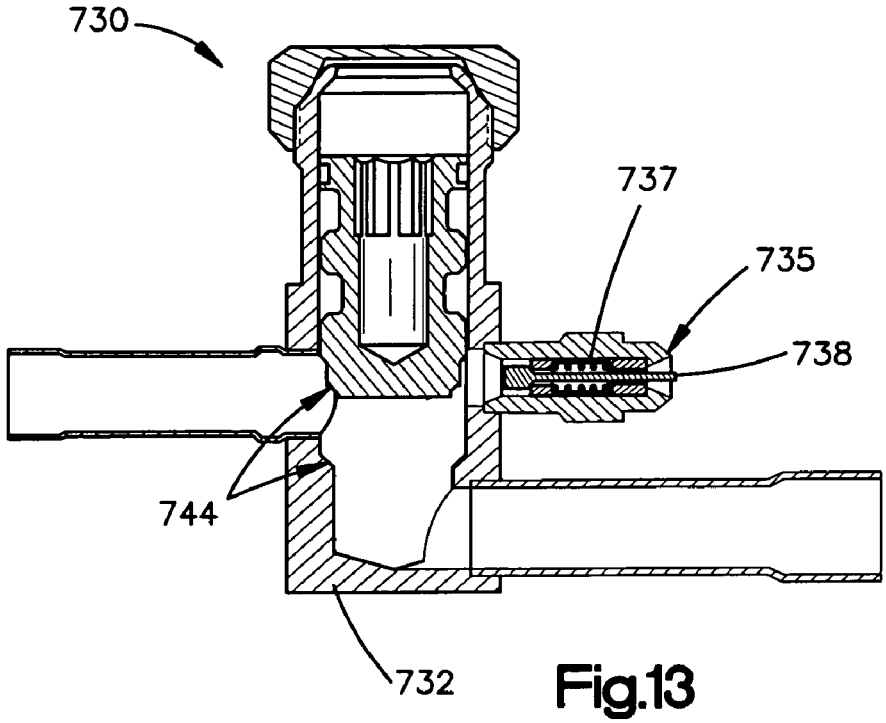
Fig.13 PRIOR ART
FIG. 13 is a cross-sectional view of a prior art front-seat valve.
Figure 14:
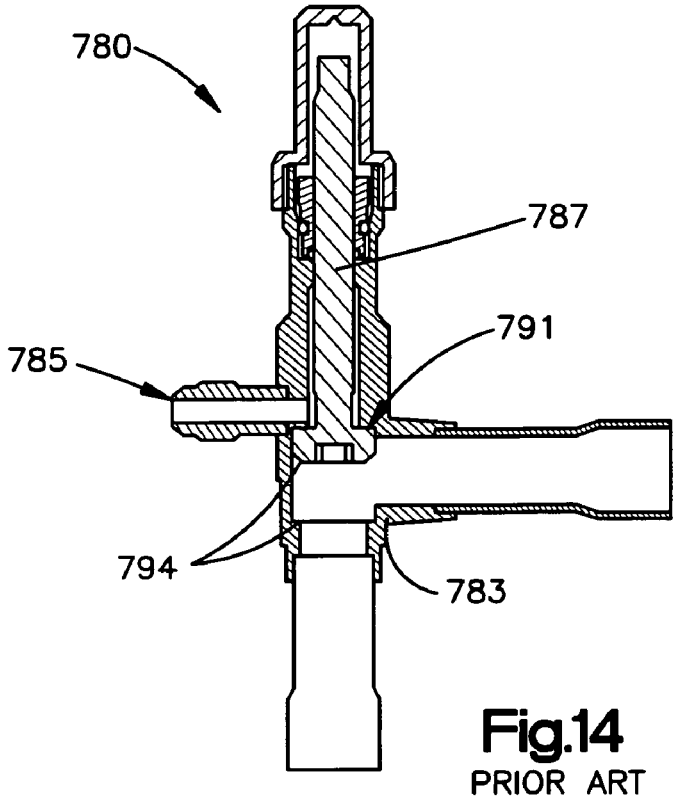
Fig.14 PRIOR ART
FIG. 14 is a cross-sectional view of a prior art back seat valve.

Valve stem 19 has a nose 42 at its front end which sealingly contacts valve body 15 and a rear portion 55 which sealingly fits within the charging conduit. In between, valve stem 19 has an annular groove 44, an annular notch 46 and an annular valley 48. Between notch 46 and valley 48 is an outwardly extending annular flange 50. Adjacent rear portion 55 are external threads 52 which mate with internal threads of cap 29. Valve stem 19 has an internal longitudinal bore 53 fluidly connected with an internal radial bore 54. It should be noted that valve stem 19 does not have a valve core 737 as is shown in prior art FIG. 13. As discussed above, the elimination of valve core 737 not only expedites the charging and evacuation of refrigerant, but also eliminates a leak path. Valve core 737 has elastomeric seals around its peripheral surface which can leak.

Valve body 15 has a first orifice 84 which leads into a braze counter bore 85 to accept a front end 57 of braze body 17, and a second orifice 88 which lead into a bore 87 having a sealing shoulder 89 onto which the nose 42 of valve stem 19 abuts in order to seal the charge port. Braze body 17 is permanently affixed, e.g. by brazing, to valve body 15 and symmetrically surrounds orifice 88. Braze body 17 further has a rear end 59 with external threads 61 and an inner annular groove 63. Annular groove is defined by a front annular wall 64 and a rear annular wall 65, both having an inner diameter smaller than that of groove 63. When fully assembled, annular groove 63 forms a cavity 72 with the outer surface of stem 19, and particularly stem annular notch 46. Cavity 72 houses a stem retaining ring 67. Nut 23 has an inwardly directed shoulder 25 having an inner surface that abuts stem annular flange 50 when nut 23 is assembled onto valve stem 19 and internal threads 26 which mate with braze body external threads 61. When fully assembled, shoulder 25 has an outer surface that contacts a nut retaining ring 75 which rests within stem annular valley 48.

When it is not necessary to charge or evacuate the system, valve stem 19 is in the position shown in FIG. 1. By applying torque to nut 23, valve stem 19 is forced to seal against valve body 15. Specifically, when nut 23 is threaded (onto braze body 17) towards body 15, nut shoulder 25 pushes valve stem annular flange 50 also towards body 15. Valve stem nose 42 sealingly abuts valve body shoulder 89 and cap 29 is threaded onto stem external threads 52 so that isolated port 12 is sealed, preventing the escape of refrigerant.

In order to charge (or evacuate) the refrigerant system, valve stem nose 42 must be moved away from valve body 15, and in particular sealing shoulder 89. When unthreading nut 23 (away from valve body 15), shoulder 25 contacts retaining ring 75 and axially moves valve stem 19 away from valve body 15. Stem 19 is restricted from fully separating from braze body 17 by stem retaining ring 67 located within cavity 72. As nut 23 is unthreaded, shoulder can push valve stem 19 away from valve body 15 until ring 67 contacts rear wall 65 stopping stem 19 from moving further. When stem 19 is moved away from valve body 15, an O-ring 77 seals the leak path between stem 19 and braze body 17. O-ring 77 is located in valve stem annular groove 44.

Refrigerant can be supplied by a conduit, more specifically a hose assembly, having an attached fitting (not shown). When cap 29 is unthreaded and removed from valve stem 19, the hose assembly fitting is threaded onto valve stem external threads 52. The fitting seals against the mating surface of valve stem rear portion 55 in order to prevent refrigerant from leaking at this connection. Refrigerant from the hose assembly enters the system through valve stem longitudinal bore 53 and passes through valve stem radial bore 54 before entering valve body 15 through bore 87.

It should be noted that when nut 23 is rotated during its threading towards valve body 15, in order to seal valve stem 19 against valve body 15, or rotated during its unthreading, in order to move valve stem 19 away from valve body, valve stem 19 moves axially without rotation. This is important in order to retain the seal between valve stem 19 and the charging conduit assembly. If valve stem 19 were allowed to rotate (with nut 23) relative to charging hose assembly, it would begin to unthread from the charging assembly fitting and allow refrigerant to leak. Specifically, when nut 23 rotates during the threading, shoulder 25 pushes valve stem annular flange 50 without causing same to rotate. Annular flange 50, and the entire stem 19, moves in the longitudinal direction without any rotation. Further, when nut 23 rotates during the unthreading, shoulder 25 pushes nut retaining ring 75, and valve stem 19, away from valve body 15 without rotating valve stem 19.

Another important feature of the present invention is the restriction of valve stem 19 from being completely removed from braze body 17. It is imperative to prevent the removal of valve stem 19 so that refrigerant does not freely escape from the system. The torque used to remove valve stem 19 from braze body 17 is transmitted from nut 23 to nut retaining ring 75. Retaining ring 75 is housed within and moves stem 19. Since stem 19 is axially moving, then so does stem retaining ring 67. Stem retaining ring 67, which is housed within cavity 72, comes in contact with rear wall 65 of braze body inner annular groove 63, but can not move braze body 17 which is affixed to valve body 15. In the event of excessive torque to nut 23, nut retaining ring 75 will fail before stem retaining ring 67 fails. This is due to the fact that, by design, stem retaining ring 67 has a greater resistance to stress than nut retaining ring 75. When this happens, nut 23 can continue to rotate but the input torque will no longer be transferred to stem 19. Consequently, valve stem 19 cannot be removed from braze body 15 through over torque (and its resultant movement) of nut 23.

Figure 5:
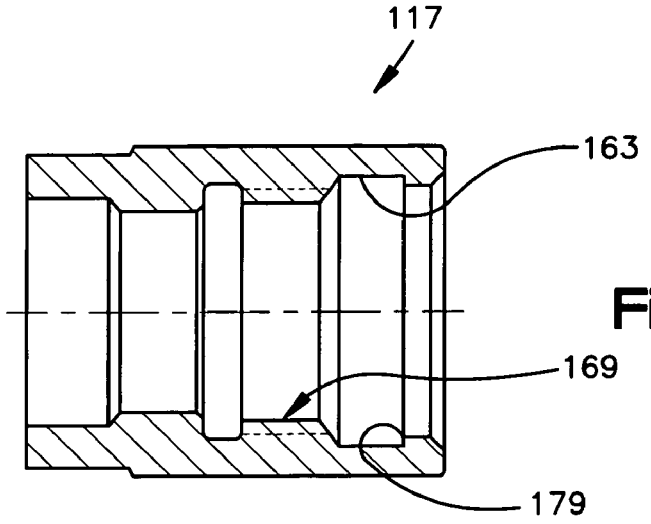
FIG. 5 is a longitudinal, cross-sectional view of a second embodiment braze body component.
Figure 6:
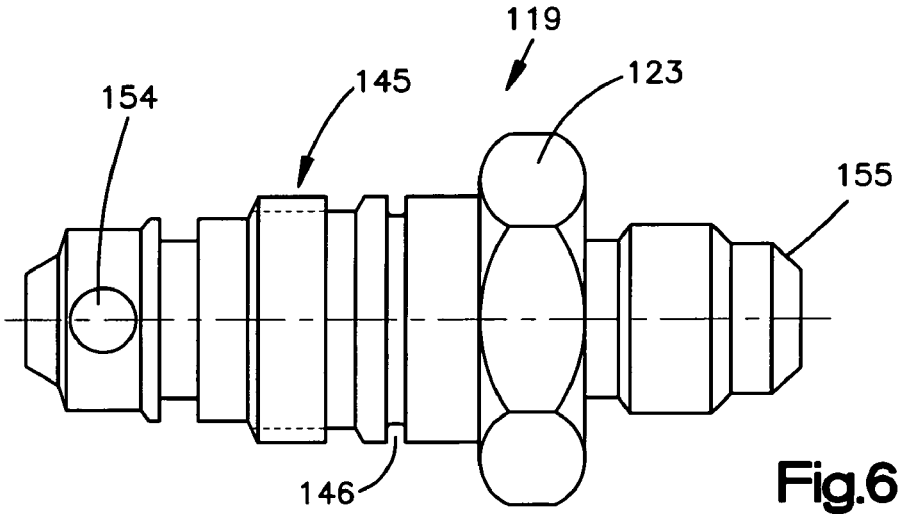
FIG. 6 is a side, elevational view of a valve stem according to the second embodiment of the present invention.

A second embodiment of the present invention is shown in FIGS. 5 and 6. Components and features of this embodiment that are identical to that explained above with service valve 10 will retain the same element numbers as above but will not again be discussed for sake of brevity. This embodiment is similar to service valve 10 except that nut 23 and valve stem 19 have been combined into a one-piece valve stem 119. Valve stem 119 has a hex 123 which replaces the function of nut 23. Valve stem 119 has external threads 145 which mate with female threads 169 of braze body 117. By torquing hex 123, valve stem 119 rotates within braze body 117 and moves towards valve body 15 until stem nose 142 sealingly abuts valve body sealing shoulder 89.

Similar to service valve 10 discussed above, valve stem 119 can not be completely removed from braze body 117. In order to fluidly communicate stem radial bore 154 with the passages within valve body 15 (during the charging and evacuation steps), stem 119 is rotated away from body 15 by torquing hex 123. Similar to the above embodiment, braze body 117 has an inner annular groove 163 that forms cavity 72 with stem annular notch 146. Stem annular notch 146 receives stem retaining ring 67. When stem 119 is unthreaded from braze body 117, it moves away from valve body 15. Stem 119 can no longer move outward when stem retaining ring 67 contacts shoulder 179 of groove 163. This prevents the unwanted removal of stem 119.

This embodiment provides a lower cost design with fewer components than the embodiment discussed above, but it does not provide the ability of stem 119 to be unthreaded from braze body 117 without the rotation of stem 119 relative to the charging hose assembly. When stem 119 is torqued (e.g. by a wrench) in order to rotate same within braze body 117, it rotates relative to the charging hose assembly attached at its rear portion 155.

Figure 12:
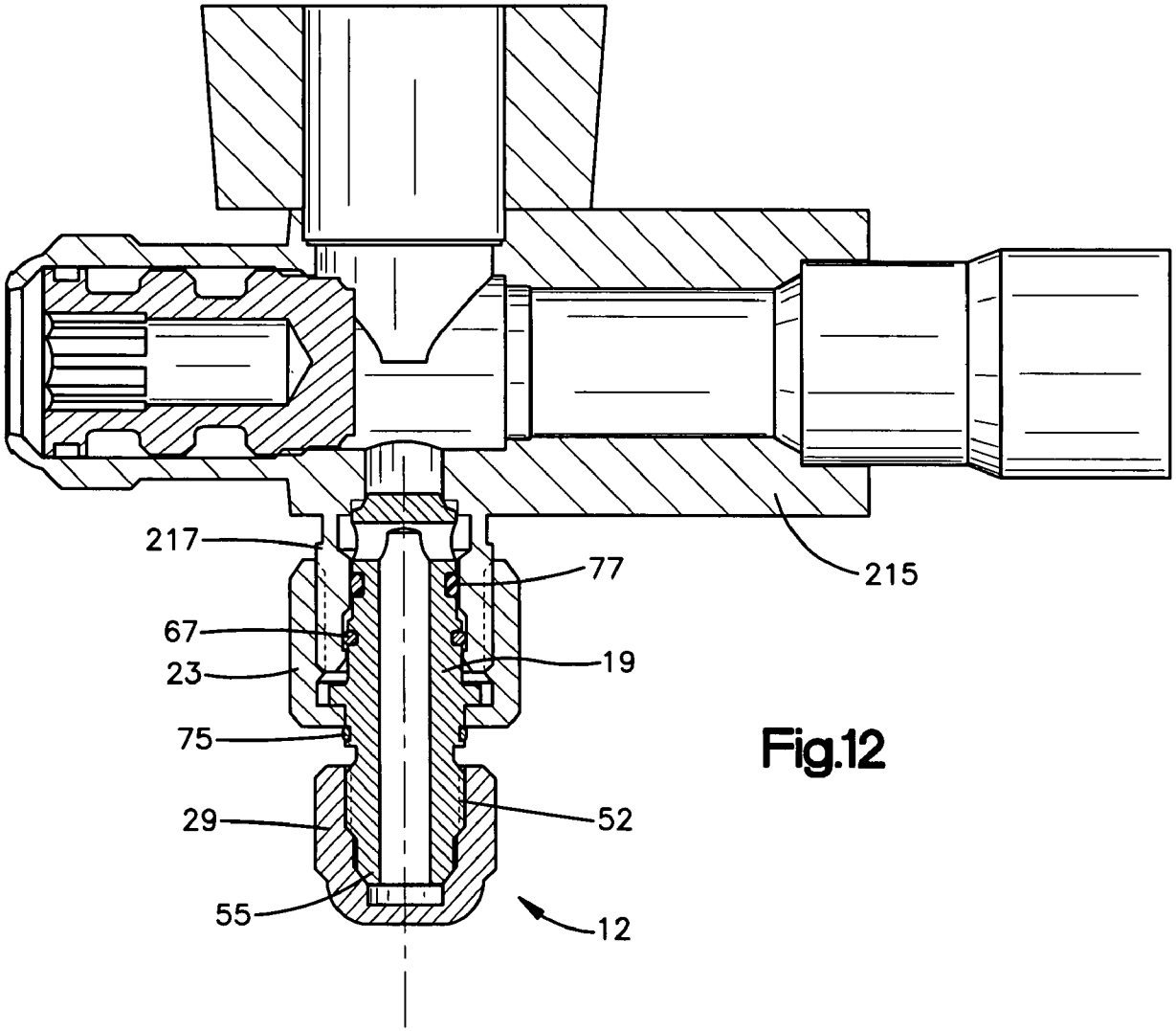
FIG. 12 is a cross-sectional view of third embodiment of a charge valve according to the present invention.

Referring to FIG. 12, a third embodiment according to the present invention is shown. Again, components and features of this embodiment that are identical to that explained with service valve 10 will retain the same element numbers as above but will not again be discussed for sake of brevity. This embodiment illustrates a valve body 215 with an annular protrusion 217 integrated in one piece. Annular protrusion 217 is formed by directly machining the braze body features (shown in the previous embodiments) into valve body 215. This eliminates any joint needed to connect separate components if the braze body and valve body were not of the same piece. This embodiment has the same additional attributes and functionalities as that described above.

Figure 2:
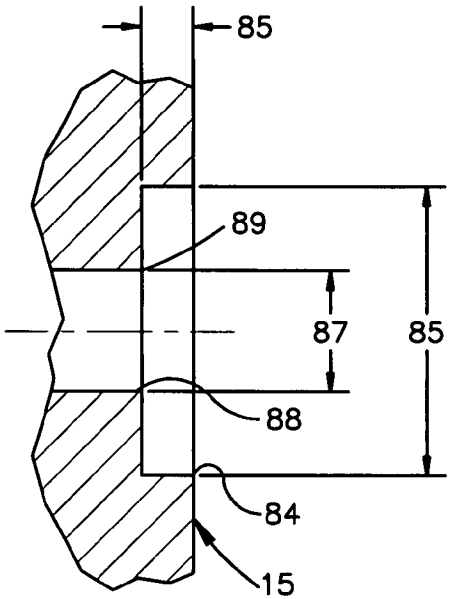
FIG. 2 is a partial sectional view of the valve body bore for receiving the isolated port shown in FIG. 1.
Figure 3:
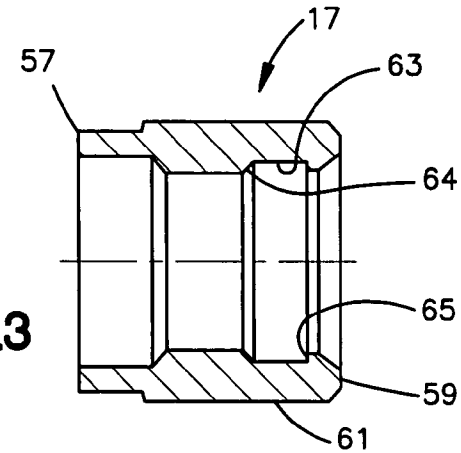
FIG. 3 is a longitudinal, cross-sectional view of the braze body shown in FIG. 1.
Figure 7:
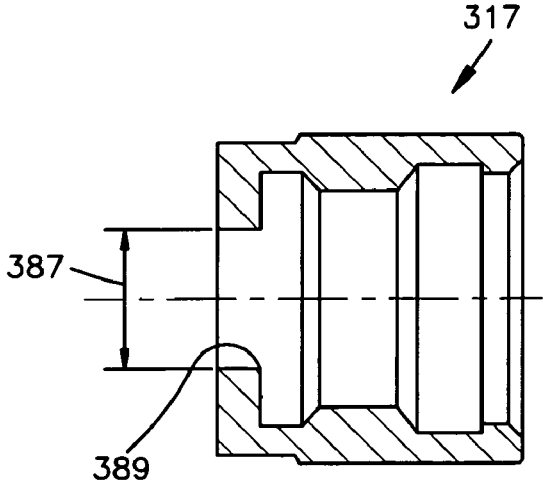
FIG. 7 is a longitudinal, cross-sectional view of a fourth embodiment braze body component according to the present invention.

Referring to FIGS. 1, 2 and 7, a fourth embodiment according to the present invention is shown. Once again, since changes have been made to few components, and not the entire service valve, components and features of this embodiment that are identical to that explained with service valve 10 will retain the same element numbers as above but will not again be discussed for brevity sake. As discussed above, when valve stem 19 is moved towards valve body 15 so that its stem nose 42 abuts sealing shoulder 89, valve stem bores, or passages, 53 and 54 are fluidly disconnected from those within valve body 15. This embodiment has located a sealing diameter within a radially directed extension 387 of braze body 317. On an edge of extension 387 is a sealing shoulder 389. Therefore when valve stem 19 is moved completely inwards, stem nose 42 does not abut sealing shoulder 89 (as shown in FIG. 1), but rather abuts braze body sealing shoulder 389. This eliminates the possibility of the sealing diameter 87 on valve body 15 from becoming misaligned with the braze body during assembly of the braze body within valve body 15.

Figure 8:
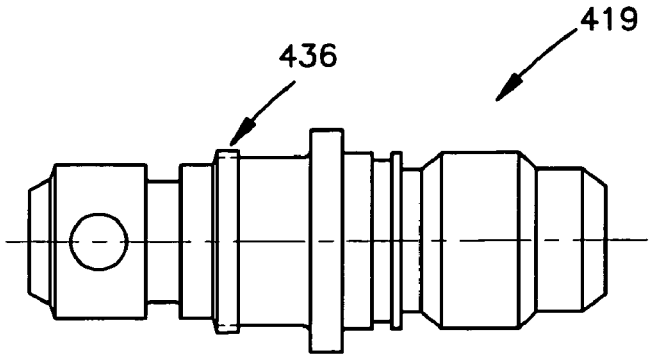
FIG. 8 is a side, elevational view of a valve stem according to the fifth embodiment of the present invention.
Figure 8A:
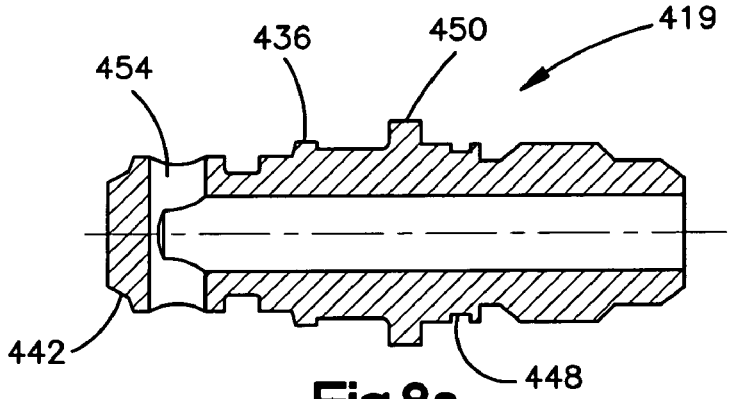
FIG. 8*a* is a longitudinal, cross-sectional view of the valve stem shown in FIG. 8.
Figure 9:
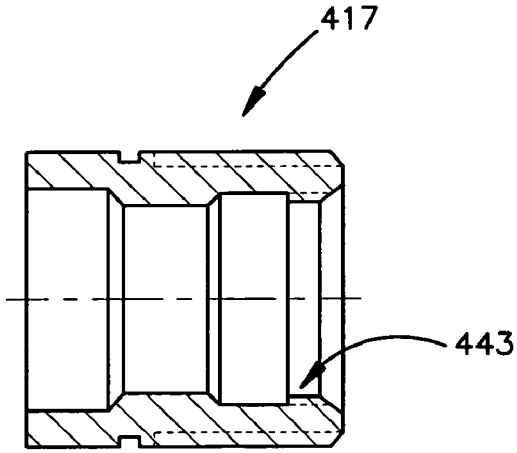
FIG. 9 is a longitudinal, cross-sectional view of a braze body component according to the fifth embodiment of the present invention.
Figure 10:
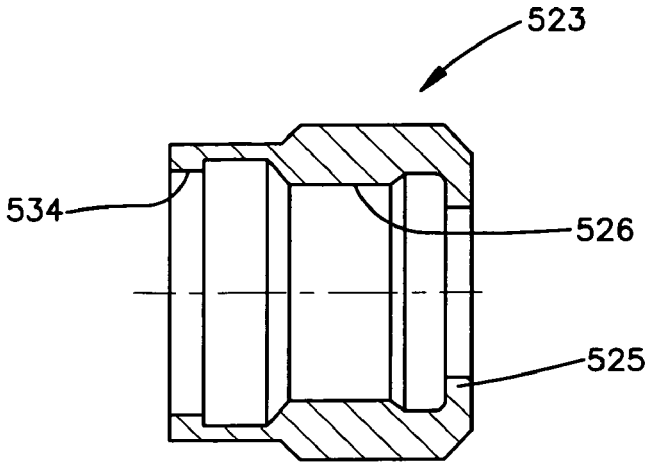
FIG. 10 is a longitudinal, cross-sectional view of a nut having a crimped end for attachment with a braze body component according to the sixth embodiment of the present invention.
Figure 11:
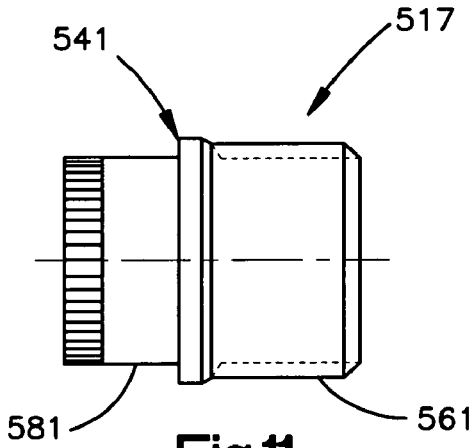
FIG. 11 is a side, elevational view of the braze body component according to the sixth embodiment.
Figure 11A:
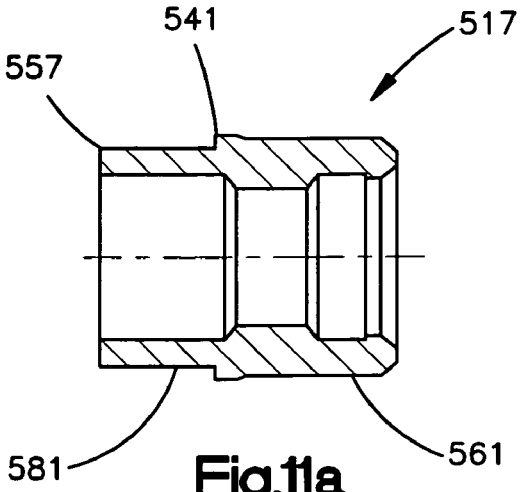
FIG. 11*a* is a longitudinal, cross-sectional view of the braze body component shown in FIG. 11.

Referring to FIGS. 1 and 8-9, a fifth embodiment of the present invention is shown. Again, components and features of this embodiment that are identical to that explained with service valve 10 will retain the same element numbers as above but will not be discussed. This embodiment provides a valve stem 419, having a series of male threads 436, originally engage with braze body female threads 443 until all male threads 436 have passed female threads 443 so that there is no thread engagement there between during its use. During its operation all stem male threads 436 will be positioned longitudinally between valve body 15 and female threads 443. When it is necessary to seal valve stem 419 against valve body 15, nut 23 is torqued, as discussed above, and nut shoulder 25 abuts stem annular flange 450 and axially moves stem 419 so that stem nose 442 sealingly contacts body sealing shoulder 89. This discontinues any fluid connection between stem bore 454 and passages within valve body 15.

When it is desired to fluidly connect stem bore 454 with the passages within valve body 15, nut 23 is rotated and unthreaded away from valve body 15. Nut shoulder 25 contacts nut retaining ring 75, housed within valve stem annular valley 448, and axially moves stem 419 away from valve body 15. It is important to note that valve stem 419 can not be completely removed from braze body 417 on account of threads 436 and 443. Specifically, stem 419 is moving axially but not rotating so stem male threads 436 do not engage with braze body female threads 443. Once stem external threads 436 abut with braze body female threads 443, stem 419 no longer moves axially, since stem external threads 436 have not engaged with braze body female threads 443. This provides a safety feature in that valve stem 419 is not inadvertently removed from braze body 417 during the rotation of nut 23. To further provide a safeguard, threads 436 and 443 can be of the left-handed variety if nut internal threads 26 and braze body external threads 61 are of the right-handed variety. Similarly, threads 436 and 443 can be of the right-handed variety if nut internal threads 26 and braze body external threads 61 are of the left-handed variety. This ensures that when nut 23 is rotated in a first direction (in mating contact with braze body external threads 61), valve stem threads 436 can not mate with braze body internal threads 61. Valve stem 419 would have to be rotated in the opposite direction in order to engage with braze body internal threads 443. Also, valve stem male threads 436 and braze body female threads 443 can have different thread pitches when compared to the threads on nut 23.

Referring to FIGS. 1, 2, 4 and 10-11*a*, a sixth embodiment according to the present invention is shown. Again, components and features of this embodiment that are identical to that explained with service valve 10 will retain the same element numbers as above but will not be discussed. This embodiment permanently affixes a nut 523 to a braze body 517 by crimping a front shoulder 534 of nut 523 over a shoulder 541 of braze body 517. Nut 523 is free to swivel on braze body 517, but is restricted in its axial movement. Similar to the embodiment shown in FIG. 1, braze body front end 557 is permanently affixed to valve body 15 within counter bore 85. When it is desired to bring valve stem 19 into abutment with valve body 15, nut 523 is rotated, or torqued, towards valve body 15 so that a series of internal threads 526 of nut 523 engage with a series of external threads 561 of braze body 517. While nut 523 moves towards valve body 15, the inside surface of nut front shoulder 534 travels on a flat outer surface 581 of braze body 517 away from braze body shoulder 541 and towards braze body front end 557. Meanwhile nut rear shoulder 525 contacts valve stem annular flange 50 thus causing valve stem 19 to axially move towards valve body 15 until stem nose 42 contacts sealing shoulder 89.

In order to remove stem 19 from valve body 15 (and fluidly connect passages within stem 19 and body 15), nut 523 is torqued in the opposite direction and moves away from valve body 15. In doing so, nut rear shoulder 525 contacts nut retaining ring 75 and axially moves stem 19 away from valve body 15. When nut 523 moves away from valve body 15, the inside surface of nut front shoulder 534 travels on braze body flat outer surface 581 towards braze body shoulder 541. Nut 523 is restricted in its movement away from valve body 15 when nut front shoulder 534 contacts braze body shoulder 541. Since nut 523 is restricted in its axial movement at this point, so is the travel of stem 19. Therefore the removal of stem 19 is prevented. It should be noted that the stem retaining ring 67, shown in FIG. 1, is not needed in this embodiment since nut front shoulder 534 provides the same feature. The elimination of stem retaining ring 67 provides for an easier assembly of the components.

Referring to FIGS. 15-19*a*, a seventh embodiment of the present invention is shown. Again, components and features of this embodiment that are identical to that explained with service valve 10 will not be discussed in detail. A service valve 610 is shown that retains the main components and features of service valve 10 but has several minor components that have been altered. Again, service valve 610 has an isolated port 612 that is comprised of an annular braze body 617, a valve stem 619, a nut 623, and a cap 629. Also again, valve stem 619 is axially moved towards and away from a valve body 615 and can not be completely removed from isolated port 612. Further, isolated port 612 does not contain a valve core as is present with prior art designs.

Valve body 615 has a plurality of passages 631 integrated within for fluidly communicating and controlling refrigerant. Although the following passages are detailed for sake of description, it should be noted that service valve 610 of the present invention could have differing passages without limiting the scope of the invention. Passages 631 include a first passage 632 that receives a front seat valve stem 695 which, as is well known in the art and discussed above, seals against valve body 615 in order to control the flow of refrigerant. A second passage 633 and a third passage 634 are also integrated within valve body 615 and receive tubing which leads to componentry, e.g. the evaporator, compressor and condensing unit, of the refrigerant system. Third passage 634 is shown connected with a tube 697 that would lead to such a component. Also included within passages 631 is a first orifice 684 that leads into a braze counter bore 685 and a second orifice 688 that lead into longitudinal bore 686. Braze body 617 has a proximal end 657 that is permanently affixed, e.g. by brazing, to valve body 615 and symmetrically surrounds both orifice 684 and 688.

Braze body proximal end 657 has a radially inwardly directed extension 687 that defines a sealing shoulder 689. Braze body 617 has a distal end 659 with external threads 661. On the inside surface of braze body 617 is an annular groove 644 for housing an O-ring 677 located between proximal end 657 and distal end 659. Also located on the inside surface of braze body 617 is an annular notch 646 for housing a stem retaining ring 667 located between annular groove 644 and distal end 658. It should be noted that both groove 644 and notch 646 are now located on braze body 617 which differs from their location within the stem as in the prior embodiments.

Figure 17A:
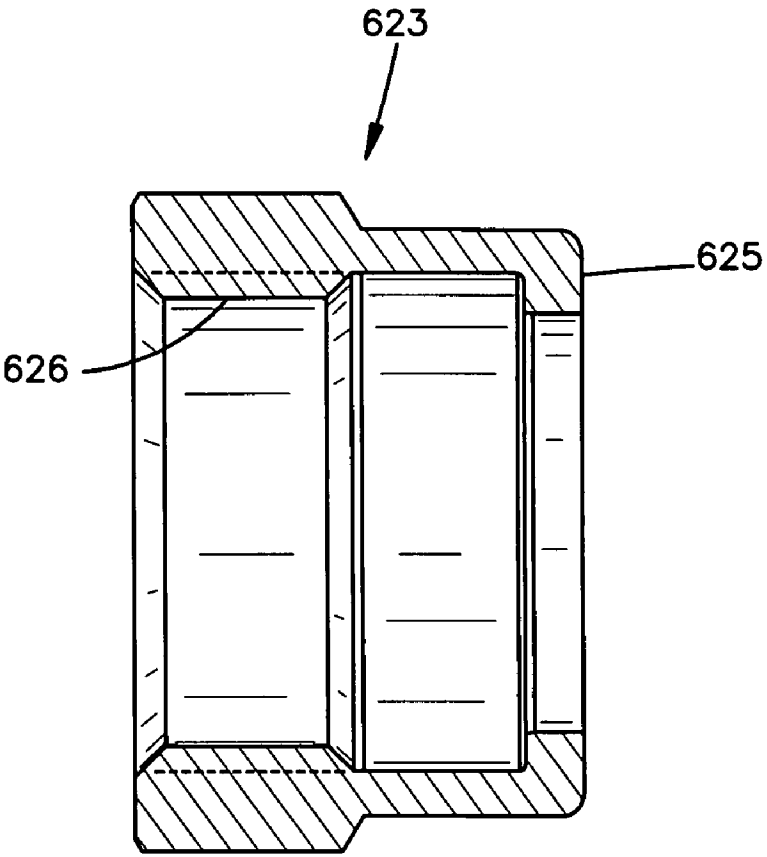
FIG. 17*a* is a longitudinal, cross-sectional view of the nut component shown in FIG. 17.
Figure 17:
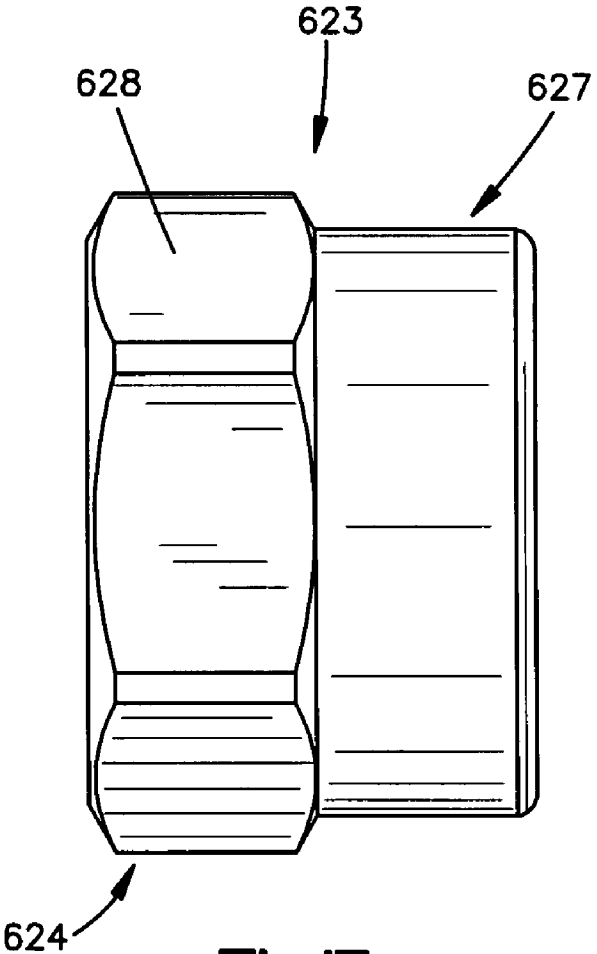
FIG. 17 is a side, elevational view of the nut component shown in FIG. 15.
Figure 18:
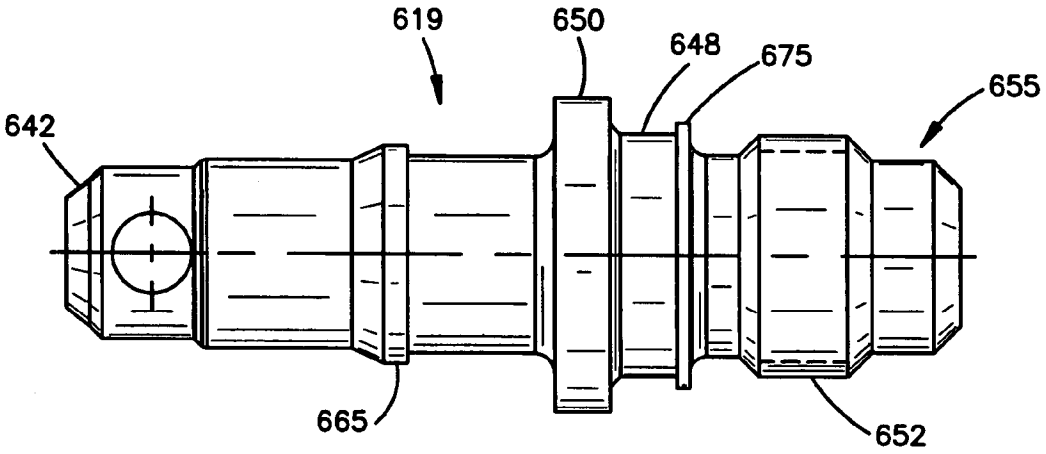
FIG. 18 is a side, elevational view of the valve stem component shown in FIG. 15.
Figure 18A:
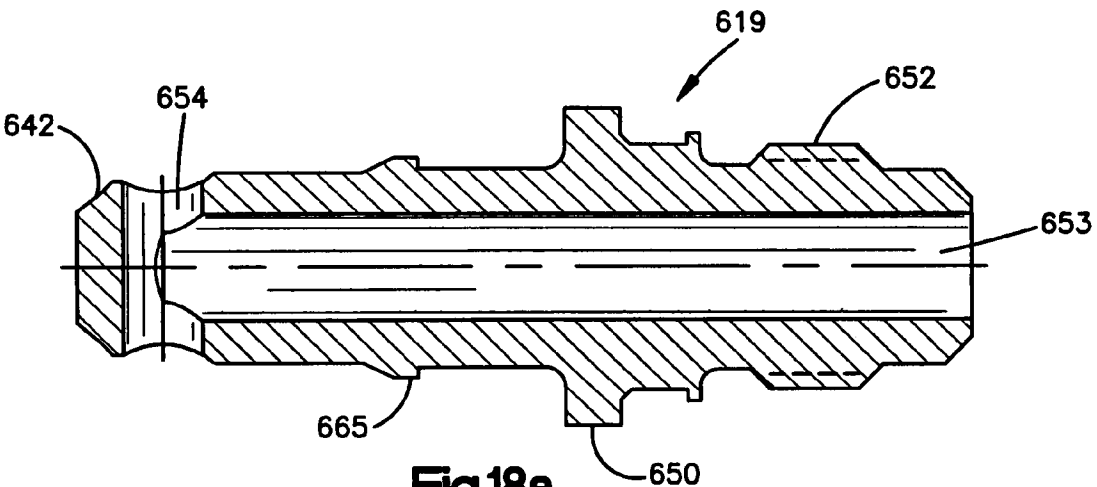
FIG. 18*a* is a longitudinal, cross-sectional view of the valve stem component shown in FIG. 18.
Figure 19:
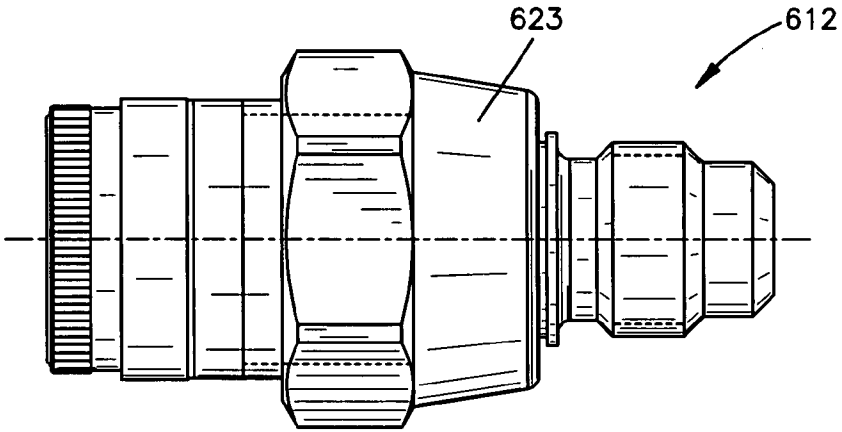
FIG. 19 is a side, elevational view of the isolated port shown in FIG. 15, removed from the valve body and without the end cap.
Figure 19A:
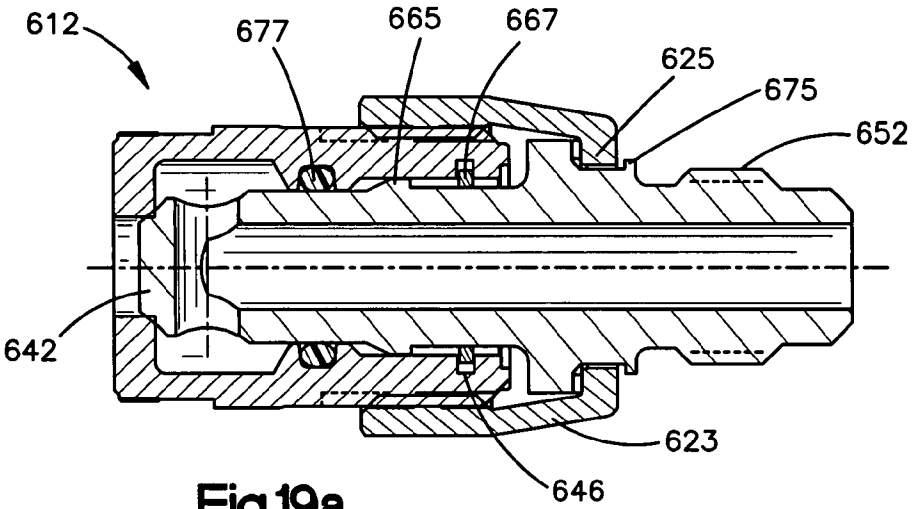
FIG. 19*a* is a longitudinal, cross-sectional view of the isolated port shown in FIG. 19.

Nut 623 has a first end 624 and a second end 627. Nut second end has an inwardly directed shoulder 625 with an inner surface that abuts the outer surface of valve stem 619 when nut 23 is assembled onto valve stem 619. It should be noted that in FIG. 17*a* nut shoulder 625 is shown radially offset. During assembly of service valve 610, nut 623 is slipped over valve stem 619 and nut second end 627 is inwardly moved, or crimped, into permanent position. Shoulder 625 is free to swivel on the outer surface of valve stem 619, but it is generally locked into place. Nut first end 624 has a series of internal threads 626 which mate with braze body external threads 661. Nut first end 624 has an outer surface 628, for example a hexagonal surface, which is engagable with a torque tool in order to rotate nut 623.

Valve stem 619 has a nose 642 at its front end which sealingly contacts sealing shoulder 689 on a radially inwardly directed extension 687 of braze body 617. As discussed above, since sealing shoulder 689 is located on braze body 617, the possibility of the sealing interface from becoming misaligned is minimized. Valve stem 619 has a rear portion 655 which sealingly fits within the charging conduit (not shown). Between nose 642 and rear portion 655 is an outwardly extending annular flange 650. Located between nose 642 and flange 650 is an outwardly extending shoulder 665. Located between flange 650 and rear portion 655 are external threads 652 which mate with the internal threads of seal cap 629. When seal cap 629 is removed, threads 652 will mate with the charging hose assembly fitting internal threads. Between threads 652 and flange 650 is a nut retaining shoulder 675. A valley 648 is located between flange 650 and nut retaining shoulder 675. When nut 623 is assembled onto stem 619, nut shoulder 625 is received within valley 648. As mentioned above, nut 623 is free to rotate about stem 619 but is axially restricted by flange 650 and shoulder 675. Valve stem 619 has an internal longitudinal bore 653 fluidly connected with an internal radial bore 654. It should be noted that valve stem 619 does not have a valve core 737 as is shown in prior art FIG. 13. As discussed above, the elimination of valve core 737 not only expedites the charging and evacuation of refrigerant, but also eliminates a leak path. Valve core 737 has elastomeric seals around its peripheral surface which can leak.

Figure 15:
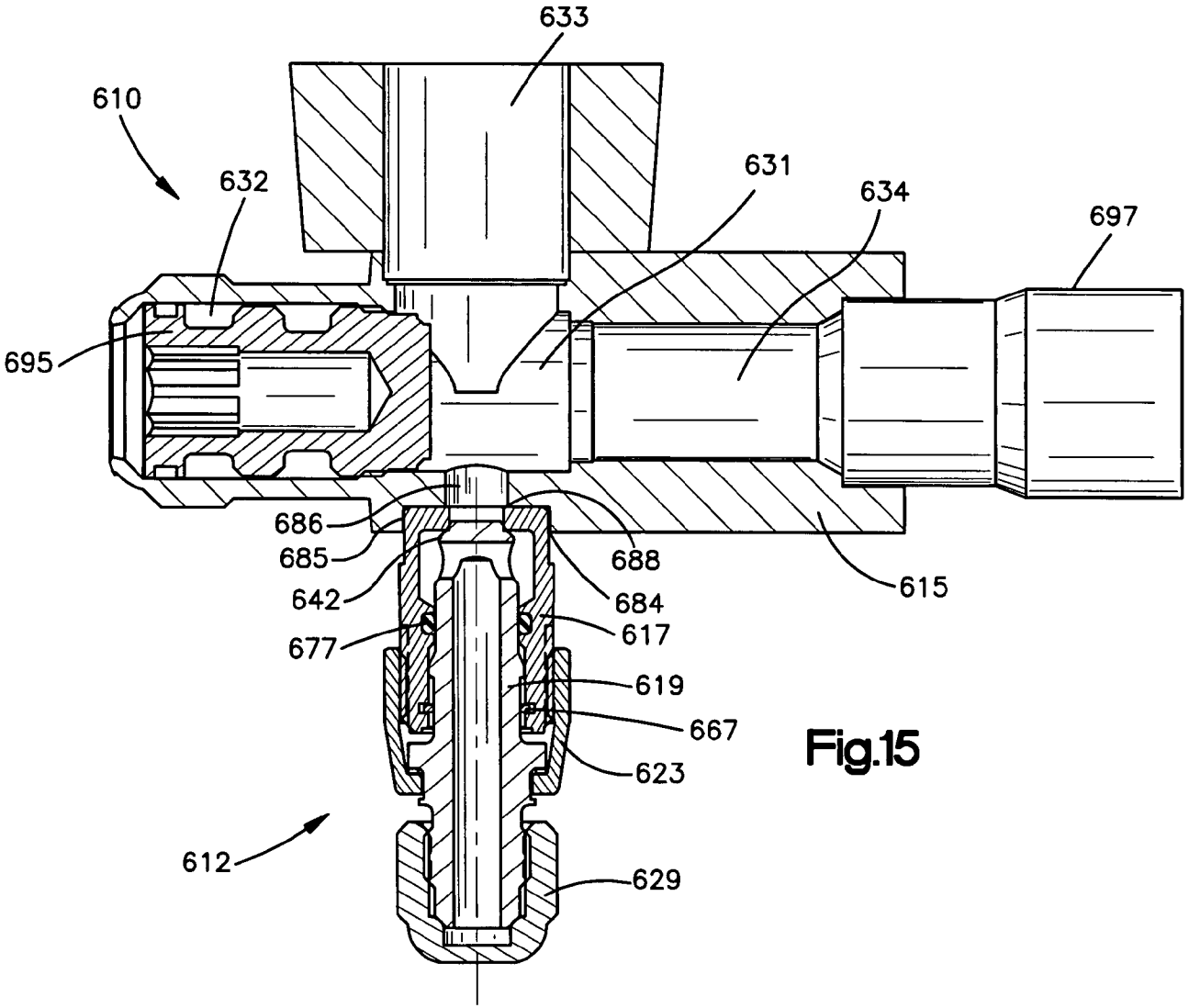
FIG. 15 is a cross-sectional view of a seventh embodiment for a charge valve according to the present invention.
Figure 16:
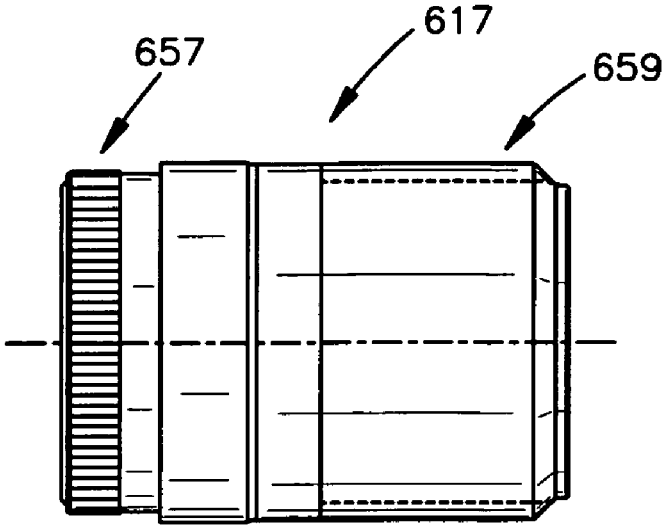
FIG. 16 is a side, elevational view of the braze body component shown in FIG. 15.
Figure 16A:
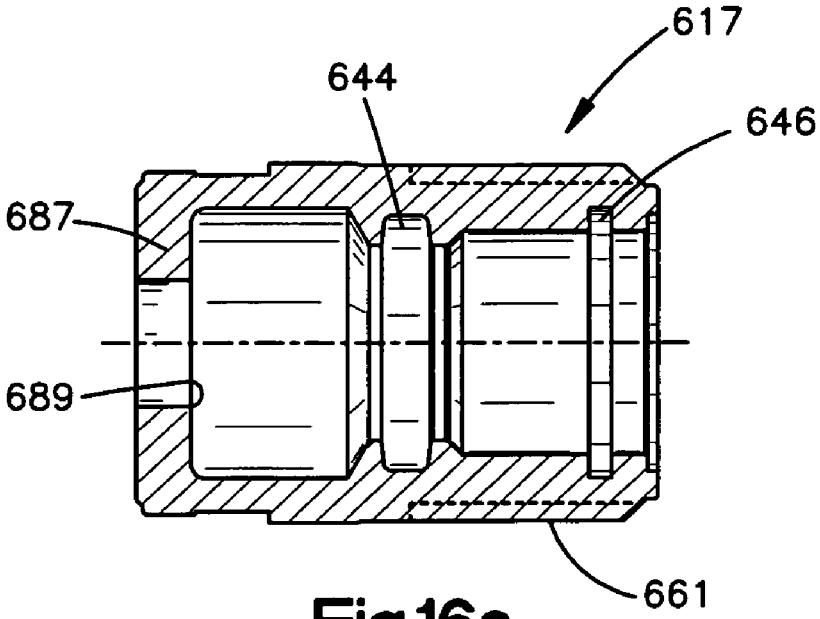
FIG. 16*a* is a longitudinal, cross-sectional view of the braze body component shown in FIG. 16.

When it is not necessary to charge or evacuate the system, valve stem 619 is in the position shown in FIG. 15. By applying torque to nut 623, valve stem 619 is forced to seal against braze body sealing shoulder 689. Specifically, when nut 623 is threaded (onto braze body 617) towards body 615, nut shoulder 625 contacts valve stem annular flange 650 and pushes valve stem 619 towards body 15. When valve stem nose 642 sealingly abuts braze body sealing shoulder 689, valve stem 619 can no longer move. Cap 629 is then threaded onto stem external threads 652 so that isolated port 612 is sealed, preventing the escape of refrigerant.

In order to charge (or evacuate) the refrigerant system, valve stem nose 642 must be moved away from valve body 615, and in particular sealing shoulder 689. When unthreading nut 623 (away from valve body 615), shoulder 625 contacts nut retaining shoulder 675 and axially moves valve stem 619 away from valve body 615. Stem 619 is restricted from fully separating from braze body 617 by stem retaining ring 667 located within annular notch 646. As nut 623 is unthreaded, shoulder 625 can push valve stem 619 away from valve body 615 until stem outwardly extending shoulder 665 contacts stem retaining ring 667 stopping stem 619 from moving further. When stem 619 is moved away from valve body 615, an O-ring 77 seals the leak path between stem 619 and braze body 617. O-ring 677 is located in braze body annular groove 644.

Again, it should be noted that when nut 623 is rotated during its threading towards valve body 615, in order to seal valve stem 619 against braze body sealing shoulder 689, or rotated in the opposite direction, in order to move valve stem 619 away from valve body 615, valve stem 619 moves axially without rotation. This is important in order to retain the seal between valve stem threads 652 and the charging assembly fitting (not shown). When it is desired to charge or evacuate the system, the charging assembly fitting is attached to valve stem threads 652. Then nut 623 is rotated in order to axially move valve stem 619 away from sealing shoulder 689, thus fluidly connecting passages 653, 654 to valve body bore 686. If valve stem 619 were allowed to rotate (with nut 623) relative to charging hose assembly, it would begin to unthread from the charging assembly fitting and allow refrigerant to leak at this connection. To prevent this leakage, when nut 623 rotates in order to seal off isolated port 612, shoulder 625 pushes valve stem annular flange 650 without causing same to rotate. Annular flange 650, and the entire stem 619, moves in the longitudinal direction without any rotation. Further, when nut 623 rotates during the opening of isolated port 612 to bore 686, shoulder 625 pushes nut retaining 675, and valve stem 619, away from valve body 615 without rotating valve stem 615. It should be noted nut retaining shoulder 675 has replaced the nut retaining ring 75 shown in the prior embodiments.

Another important feature of the present invention is the restriction of valve stem 619 from being completely removed from braze body 617. It is imperative to prevent the removal of valve stem 619 so that refrigerant does not freely escape from the system. The torque used to remove valve stem 619 from braze body 617 is transmitted from nut 623 to nut retaining shoulder 675 thus moving stem 619 and its outwardly extending shoulder 665. Stem shoulder 665 will contact stem retaining ring 667, which is housed within fixed brazed body annular notch 646, and will stop since it can not move braze body 617 which is affixed to valve body 615. This is the greatest extent of axial movement of valve stem 619 away from valve body 615. In the event of excessive torque to nut 623, nut retaining shoulder 675 will fail before stem retaining ring 667 fails. By design, stem retaining ring 667 has a greater resistance to the stress forces than does nut retaining shoulder 675. When this happens, nut 623 can continue to rotate but the input torque will no longer be transferred to stem 619. Consequently, valve stem 619 cannot be removed from braze body 615 through over torque (and its resultant movement) of nut 623.

It should be noted that the present invention is not limited to the specified preferred embodiments and principles. Those skilled in the art to which this invention pertains may formulate modifications and alterations to the present invention. These changes, which rely upon the teachings by which this disclosure has advanced, are properly considered within the scope of this invention as defined by the appended claims.

The invention claimed is:

1. A service valve comprising:

a valve body having at least one fluid passage integrated therein, a first valve stem for controlling a flow of fluid through the at least one fluid passage, an isolation port associated with the valve body, the isolation port in fluid communication with the at least one fluid passage through a longitudinal bore that extends through the valve body, an orifice located at one end of the bore, and an annular body axially extending from the valve body and about the orifice; and a second valve stem having a first end, a second end, and a bore integrated within, the second valve stem being movable within the annular body between at least a first position in which the second valve stem first end prevents the flow of fluid between the at least one fluid passage and the isolation port through the longitudinal bore and a second position in which the valve stem first end allows the flow of fluid between the at least one fluid passage and the isolation port through the longitudinal bore, the second valve stem and the annular body having features for restricting the second valve stem from being completely removed from the annular body during movement away from the valve body, wherein the features include one of the second valve stem and the annular body including a groove for receiving a retaining ring and the other of the second valve stem and the annular body including a shoulder for engaging the retaining ring.

2. The service valve as in claim 1 wherein said annular body is affixed to said valve body.

3. The service valve as in claim 2 wherein said annular body includes a radially inwardly directed extension that defines a sealing shoulder against which the second valve stem abuts to prevent the flow of fluid between the at least one fluid passage and the isolation port through the longitudinal bore.

4. The service valve as in claim 3 wherein said valve stem includes a nose portion for abutting against the sealing shoulder to prevent the flow of fluid between the at least one fluid passage and the isolation port through the longitudinal bore.

5. The service valve as in claim 1 wherein said second valve stem further includes a radially outwardly extending flange and a nut retaining component, a nut associated with the second valve stem and having a portion interposed between the radially outwardly extending flange and the nut retaining component, the nut being threaded to the annular body and, when rotated relative to the annular body, moving the second valve stem axially relative to the longitudinal bore.

6. The service valve as in claim 5 wherein said nut retaining component is a nut retaining shoulder that is formed integrally with the second valve stem.

7. The service valve as in claim 1 wherein said at least one fluid passage includes at least first and second fluid passages that are in fluid communication with one another and are oriented orthogonal to one another, the longitudinal bore being coaxial with the second fluid passage on a side of the valve body opposite the second fluid passage.

* * * * *